US010139778B2

(12) United States Patent
Lee et al.

(10) Patent No.: US 10,139,778 B2
(45) Date of Patent: Nov. 27, 2018

(54) IMAGE FORMING APPARATUS AND METHOD OF CONTROLLING TRANSFER POWER THEREOF

(71) Applicant: S-Printing Solution Co., Ltd., Suwon-si (KR)

(72) Inventors: Sun-woo Lee, Suwon-si (KR); Jeong-ho Choe, Bucheon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/442,046

(22) Filed: Feb. 24, 2017

(65) Prior Publication Data

US 2018/0024496 A1 Jan. 25, 2018

(30) Foreign Application Priority Data

Jul. 20, 2016 (KR) ..... 10-2016-0091994

(51) Int. Cl.
*G03G 15/16* (2006.01)
*G03G 15/00* (2006.01)
*G03G 21/20* (2006.01)

(52) U.S. Cl.
CPC ..... *G03G 21/203* (2013.01); *G03G 15/167* (2013.01); *G03G 15/1645* (2013.01); *G03G 15/1675* (2013.01); *G03G 15/5004* (2013.01)

(58) Field of Classification Search
CPC ..... G03G 15/1645; G03G 15/167; G03G 15/1675; G03G 15/5004; G03G 21/203
See application file for complete search history.

(56) References Cited

U.S. PATENT DOCUMENTS 9,158,242 B2 10/2015 Saito
2016/0161888 A1* 6/2016 Wada ..... G03G 15/1665 399/66

FOREIGN PATENT DOCUMENTS

JP 2000-331038 11/2000

* cited by examiner

*Primary Examiner* — Joseph S Wong
(74) *Attorney, Agent, or Firm* — Staas & Halsey LLP

(57) ABSTRACT

A method of controlling transfer power of an image forming apparatus includes: determining a sensing feedback voltage by applying a set sensing current and measuring a first output voltage during a time period before an image is transferred to a transfer medium; measuring humidity and comparing the measured humidity with a set value; setting a target voltage based on the determined sensing feedback voltage when the measured humidity is equal to or higher than the set value; and adjusting the transfer current to apply the target voltage during a time period in which the image is transferred to the transfer medium.

17 Claims, 12 Drawing Sheets

FIG. 5

510

| SENSING FEEDBACK VOLTAGE | TARGET VOLTAGE | | | TRANSFER POWER APPLICATION METHOD | CONDITION |
|---|---|---|---|---|---|
| | PAPER A | PAPER B | PAPER C | | |
| 50V | 600V | 750V | 900V | PSEUDO CONSTANT VOLTAGE METHOD | HUMIDITY ≥ 60% |
| 100V | 700V | 850V | 1000V | | |
| 200V | 820V | 970V | 1120V | | |
| 500V | 1000V | 1150V | 1300V | | |
| 1000V | 1200V | 1350V | 1500V | | |

520

| SENSING FEEDBACK VOLTAGE | TARGET CURRENT | | | TRANSFER POWER APPLICATION METHOD | CONDITION |
|---|---|---|---|---|---|
| | PAPER A | PAPER B | PAPER C | | |
| 1000V | 10.2 μA | 10.8 μA | 9.6 μA | CONSTANT CURRENT METHOD | HUMIDITY < 60% |
| 2000V | 9.8 μA | 10.4 μA | 9.2 μA | | |
| 3000V | 9.2 μA | 9.8 μA | 8.6 μA | | |
| 4000V | 8.8 μA | 9.4 μA | 8.2 μA | | |
| 5000V | 8.4 μA | 9.0 μA | 7.8 μA | | |

FIG. 6

| SENSING FEEDBACK VOLTAGE | TARGET VOLTAGE/CURRENT | | | TRANSFER POWER APPLICATION METHOD | CONDITION |
|---|---|---|---|---|---|
| | PAPER A | PAPER B | PAPER C | | |
| 50V | 600V | 750V | 900V | PSEUDO CONSTANT VOLTAGE METHOD | HUMIDITY ≥ 60% & SENSING FEEDBACK VOLTAGE < 100V |
| 100V | 700V | 850V | 1000V | | |
| 200V | 15.0 μA | 15.6 μA | 14.4 μA | CONSTANT CURRENT METHOD | HUMIDITY < 60% OR SENSING FEEDBACK VOLTAGE ≥ 100V |
| 500V | 14.2 μA | 14.8 μA | 13.6 μA | | |
| 1000V | 12.1 μA | 12.7 μA | 11.5 μA | | |

FIG. 8

| HUMIDITY | TARGET VOLTAGE | | | TRANSFER POWER APPLICATION METHOD | CONDITION |
|---|---|---|---|---|---|
| | PAPER A | PAPER B | PAPER C | | |
| EQUAL TO OR HIGHER THAN 80% | 400V | 450V | 500V | PSEUDO CONSTANT VOLTAGE METHOD | SECOND OUTPUT VOLTAGE ≤ EFFECTIVE TRANSFER VOLTAGE |
| 79~70% | 430V | 480V | 530V | | |
| 69~60% | 460V | 510V | 560V | | |
| 59~50% | 490V | 540V | 590V | | |
| 49~40% | 520V | 570V | 620V | | |
| 39~30% | 550V | 600V | 650V | | |

FIG. 9

| SECOND OUTPUT VOLTAGE | TARGET VOLTAGE | | | TRANSFER POWER APPLICATION METHOD | CONDITION |
|---|---|---|---|---|---|
| | PAPER A | PAPER B | PAPER C | | |
| | EFFECTIVE TRANSFER VOLTAGE = 400V | EFFECTIVE TRANSFER VOLTAGE = 500V | EFFECTIVE TRANSFER VOLTAGE = 600V | | |
| 100V | 320V | 350V | 680V | PSEUDO CONSTANT VOLTAGE METHOD | SECOND OUTPUT VOLTAGE ≤ EFFECTIVE TRANSFER VOLTAGE |
| 200V | 350V | 380V | 410V | | |
| 300V | 380V | 410V | 440V | | |
| 400V | 400V | 450V | 500V | | |
| 500V | | 500V | 550V | | |
| 600V | | | 600V | | |

IMAGE FORMING APPARATUS AND METHOD OF CONTROLLING TRANSFER POWER THEREOF

CROSS-REFERENCE TO RELATED APPLICATIONS

This application claims the benefit of Korean Patent Application No. 10-2016-0091994, filed on Jul. 20, 2016, in the Korean Intellectual Property Office, the disclosure of which is incorporated herein in its entirety by reference.

BACKGROUND

1. Field

The present disclosure relates to an image forming apparatus and a method of controlling transfer power thereof.

2. Description of the Related Art

An image forming apparatus may print an image on a transfer medium through a series of processes including an exposing process, a developing process, a transfer process, and a fixing process. During the transfer process among the above processes, an image formed on a photoreceptor is directly transferred to a transfer medium, for example, paper, on which the image is to be finally formed, or is secondarily transferred to the transfer medium from an intermediate transfer member after the image is primarily transferred to the intermediate transfer member.

In more detail, particles of a developing agent existing on the photoreceptor or a surface of the intermediate transfer member are transferred to the transfer medium due to electrostatic force as a voltage having a polarity opposite to a charged polarity is applied to the transfer medium. In this case, a constant current (CC) method of applying a constant current to a transfer member, for example, a transfer roller, which is located on an opposite side to the transfer medium, or a constant voltage (CV) method of applying a constant voltage to the transfer member may be used as a method of applying a voltage to an opposite side to the transfer medium.

According to the CC method, it is difficult to react to problems that may occur due to humidity of paper in a high-humidity environment. In particular, when paper having high humidity (e.g., at least 10%) is used, a transfer voltage cannot reach an effective transfer voltage level, and thus poor transfer is highly likely to occur. In addition, according to the CV method, in a low-humidity environment in which a transfer margin is small, it is difficult to react to changes in resistance of a transfer member and resistance of paper according to manufacturers, and particularly, to the changes when images are printed on both sides of highly resistive paper.

According to a hybrid method using both the CC method and the CV method, manufacturing costs of an image forming apparatus and a difficulty level of designing the image forming apparatus may increase because it is required to use two types of transfer power.

SUMMARY

Provided are an image forming apparatus that has one constant current (CC) transfer power and is operable in a similar manner to a constant voltage (CV) method according to environmental conditions, and a method of controlling the transfer power of the image forming apparatus.

Additional aspects will be set forth in part in the description which follows and, in part, will be apparent from the description, or may be learned by practice of the presented embodiments.

According to an aspect of an embodiment, an image forming apparatus includes: a humidity sensor; a transfer unit configured to transfer an image on a photoreceptor to a transfer medium; a power supply configured to apply a transfer current to the transfer unit and supply transfer power to the transfer unit; and a controller configured to control the transfer power supplied by the power supply to the transfer unit, wherein the controller is configured to determine a sensing feedback voltage by applying a preset sensing current to the transfer unit and measuring a first output voltage of the transfer unit in a certain time period before the image is transferred to the transfer medium, to set a target voltage based on the determined sensing feedback voltage when the humidity measured by the humidity sensor is higher than a preset value, and to control the power supply to adjust the transfer current in order to apply the target voltage to the transfer unit in a time period in which the image is transferred to the transfer medium.

According to an aspect of another embodiment, a method of controlling transfer power of an image forming apparatus, includes: determining a sensing feedback voltage by applying a preset sensing current and measuring a first output voltage in a certain time period before an image is transferred to a transfer medium; measuring humidity and comparing the measured humidity with a preset value; setting a target voltage based on the determined sensing feedback voltage when the measured humidity is equal to or higher than the preset value; and adjusting the transfer current to apply the target voltage in a time period in which the image is transferred to the transfer medium.

BRIEF DESCRIPTION OF THE DRAWINGS

These and/or other aspects will become apparent and more readily appreciated from the following description of the embodiments, taken in conjunction with the accompanying drawings in which:

FIG. 5 is tables of examples of transfer power application methods according to environmental conditions;

FIG. 6 is a table of an example of a transfer power application method according to an environmental condition and a sensing feedback voltage;

FIG. 8 is a table of an example of a transfer power application method in a boundary between a constant current (CC) method and a pseudo CV method;

FIG. 9 is a table of an example of a transfer power application method used according to a sensing feedback voltage, in a boundary between a CC method and a pseudo CV method;

DETAILED DESCRIPTION

The present disclosure will now be described more fully with reference to the accompanying drawings, in which exemplary embodiments of the present disclosure are shown. The present disclosure may be embodied in many different forms and should not be construed as being limited to the embodiments set forth herein; rather, these embodiments are provided so that this present disclosure will be thorough and complete, and will fully convey the concept of the present disclosure to those of ordinary skill in the art.

It will be understood that when a component is referred to as being "connected to" another component, the component can be 'directly' connected to the other component or intervening components may be present therebetween. When a portion "includes" an element, another element may be further included, rather than excluding the existence of the other element, unless otherwise described.

Throughout the specification, the term "image forming job" may indicate image formation or various jobs (e.g., printing, scanning, faxing, etc.) related to an image, for example, production, storage, transmission, etc. of an image file. The term 'job' may indicate an image forming job as well as processes necessary to perform the image forming job.

In addition, the term "image forming apparatus" may indicate all apparatuses, for example, a printer, a scanner, a fax machine, a multi-function printer (MFP), a display apparatus, and the like, which are used to perform an image forming job.

The term "content" may include all types of data such as pictures, images, documents, or the like which are targets of the image forming job.

The term "print data" may indicate data that may be printed by a printer.

Also, the term "user" indicates a person who performs manipulations related to an image forming job by using an image forming apparatus or a device connected to the image forming apparatus in a wired or wireless manner. In addition, the term "administrator" indicates a person who has authority to access all functions or a system of the image forming apparatus. The "administrator" may be the same person as the "user".

A "sensing feedback voltage" is an output voltage that is measured in a transfer unit after a sensing current is applied to the transfer unit.

"Poor transfer" means that particles of a developing agent have not been completely transported to a transfer medium, and thus some particles are left on a surface of a photoreceptor.

An "effective transfer voltage" indicates a minimum voltage that has to be applied to transfer an image.

A "pseudo constant voltage (CV) method" indicates a method of implementing a CV method through an effect whereby a constant voltage is applied by controlling a current.

The term "humidity" indicates relative humidity. However, one of skill in the art can readily see how to perform the same operations using absolute or specific humidity.

Figure 1:
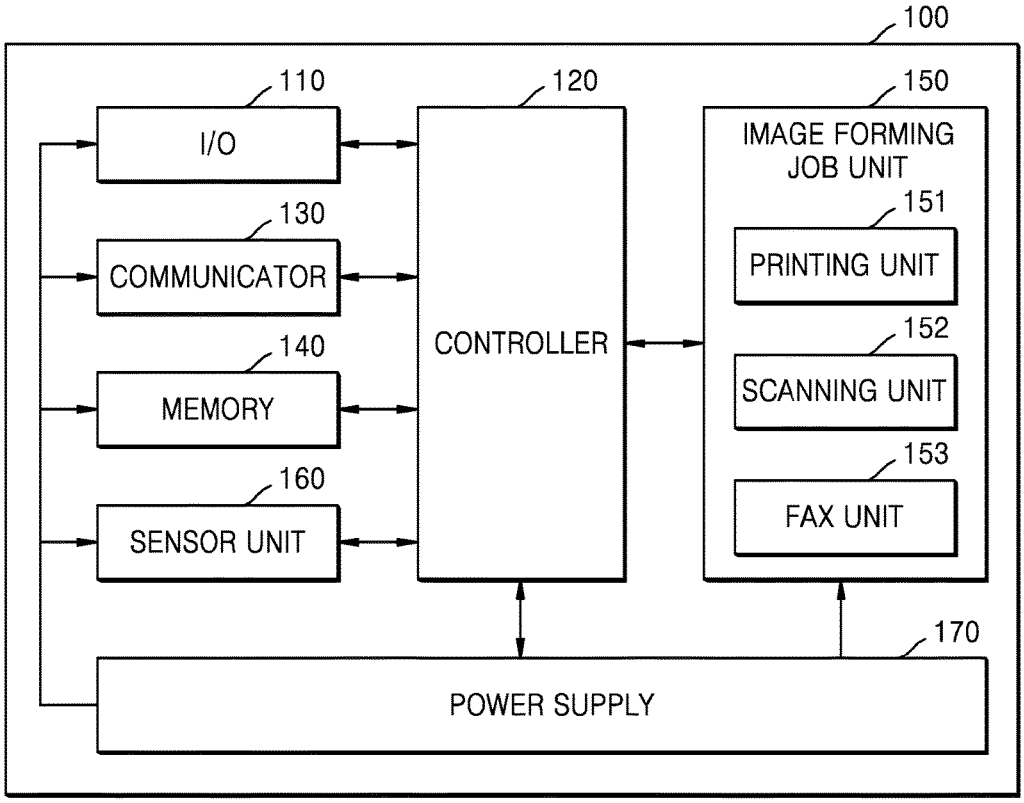
FIG. 1 is a block diagram showing an internal structure of an image forming apparatus according to an embodiment.

FIG. 1 is a block diagram showing an internal structure of an image forming apparatus 100 according to an embodiment.

FIG. 1 shows a structure of the image forming apparatus 100 according to an embodiment. Referring to FIG. 1, the image forming apparatus 100 may include an inputter/outputter (I/O) 110, a controller 120, a communicator 130, a memory 140, an image forming job unit 150, and a sensor unit 160. The image forming apparatus 100 may further include a power supply for supplying power to each component of the image forming apparatus 100.

The I/O 110 may include an inputter that receives, from a user, an input, etc. for performing an image forming job and an outputter that displays a result of the image forming job or information regarding a state of the image forming apparatus 100, etc. For example, the I/O 110 may include an operation panel for receiving a user input, a display panel for showing a screen, or the like.

In detail, the inputter may include devices, for example, a keyboard, a physical button, a touch screen, a camera, a microphone, etc., which may receive various types of user inputs. Also, the outputter may include, for example, a display panel, a speaker, etc. However, the present disclosure is not limited thereto. The I/O 110 may include a device that supports various inputs and outputs.

The controller 120 may control all operations of the image forming apparatus 100 and may include a processor such as a central processing unit (CPU). The controller 120 may control other components included in the image forming apparatus 100 to perform operations corresponding to the user inputs received through the I/O 110.

For example, the controller 120 may execute programs stored in the memory 140, read files stored in the memory 140, and store new files in the memory 140.

The communicator 130 may perform wired/wireless communication with other devices or a network. To this end, the communicator 130 may include a communication module that supports at least one of various wired/wireless communication methods. For example, the communication module may be a chipset or may be a sticker/a barcode (e.g., a sticker including a near field communication (NFC) tag) including information necessary for communication.

The wireless communication may include, for example, at least one of Wireless Fidelity (W-Fi), W-Fi Direct, Bluetooth, Ultra Wide Band (UWB) and NFC. The wired communication may include, for example, at least one of a universal serial bus (USB) and a High Definition Multimedia Interface (HDMI).

The communicator 130 may be connected to an external device outside the image forming apparatus 100 and may receive/transmit signals or data from/to the external device. The external device may include, for example, a smart phone, a tablet computer, a personal computer (PC), a home appliance, a medical device, a camera, a wearable device, or the like.

The communicator 130 may receive/transmit signals or data from/to a server directly connected to the communicator 130. Also, the communicator 130 may be connected to the external device through the server 300. That is, the communicator 130 of the image forming apparatus 100 may receive/transmit signals or data from/to a communicator of the external device 230 through the server 300.

Programs such as applications and data such as files may be installed and stored in the memory 140. The controller 120 may access and use the data stored in the memory 140 or may store new data in the memory 140. Also, the controller 120 may execute the programs installed in the memory 140. Also, the controller 120 may install, in the memory 140, applications received from the outside through the communicator 130.

The image forming job unit 150 may perform an image forming job such as printing, scanning, or faxing.

Referring to FIG. 1, the image forming job unit 150 includes a printing unit 151, a scanning unit 152, and a fax unit 153. However, according to necessity, the image forming job unit 150 may include only some of the printing unit 151, the scanning unit 152, and the fax unit 153 or may further include other components that perform other image forming jobs.

The printing unit 151 may produce an image on a transfer medium by using various printing methods such as an electrophotography method, an inkjet method, a thermal transfer method, and a thermosensitive method. For example, the printing unit 151 may print an image on the transfer medium through a series of processes including an exposing process, a developing process, a transfer process, and a fixing process. The printing unit 151 will be further described with reference to FIG. 2.

Figure 2:
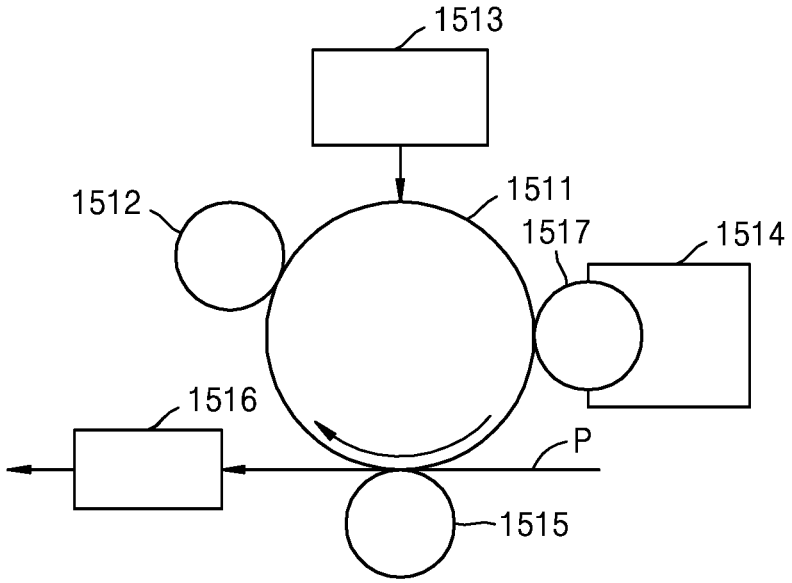
FIG. 2 is a diagram of a printing unit according to an embodiment.

FIG. 2 is a diagram of the printing unit 151 according to an embodiment.

Referring to FIG. 2, the printing unit 151 may include a photoreceptor 1511, a charging unit 1512, an exposure unit 1513, a developing unit 1514, a transfer unit 1515, and a fixing unit 1516. The printing unit 151 may further include a paper-feeding unit (not shown) that provides a transfer medium P. An electrostatic latent image is formed on the photoreceptor 1511. The photoreceptor may be referred to as a photoconductive drum, a photoconductive belt, or the like, depending on its type. The charging unit 1512 charges a surface of the photoreceptor 1511 to a constant electric potential. The charging unit 1512 may be embodied as a corona charger, a charging roller, a charging brush, or the like. The exposure unit 1513 changes an electric potential of the surface of the photoreceptor 1511 based on information regarding an image to be printed, and thus the electrostatic latent image is formed on the surface of the photoreceptor 1511. For example, the exposure unit 1513 irradiates light, which is modulated based on the information regarding the image to be printed, onto the photoreceptor 1511 so as to produce the electrostatic latent image. The exposure unit 1513 may be referred to as an optical scanning unit, or the like. The developing unit 1514 includes a developing agent therein and provides the developing agent to the electrostatic latent image, thereby developing a visible image. The developing unit 1514 may include a developing roller 1517 that provides the developing agent to the electrostatic latent image. For example, the developing agent may be provided from the developing roller 1517 to the electrostatic latent image formed on the photoreceptor 1511 due to a developing electric field between the developing roller 1517 and the photoreceptor 1511. The visible image formed on the photoreceptor 1511 is transferred to the transfer medium P by the transfer unit 1515. The transfer unit 1515 may transfer the visible image to the transfer medium P by using, for example, an electrostatic transfer method. The visible image is fixed to the transfer medium P by electrostatic attraction. The fixing unit 1516 fixes the visible image to the transfer medium P by applying heat and/or pressure to the visible image on the transfer medium P. A printing job is completed through the above-described processes.

Referring back to FIG. 1, the scanning unit 152 may irradiate light onto a document and may read an image recorded on the document by receiving light reflected from the document. A charge coupled device (CCD), a contact type image sensor (CIS), or the like may be used as an image sensor that reads the image from the document. The scanning unit 152 may have a flatbed structure, in which a document is fixed at a certain location and an image is read from the document by a moving image sensor, a document-feed structure, in which an image sensor is fixed at a certain location and a document is moved relative thereto, or a combination thereof.

The fax unit 153 may share a component for scanning an image with the scanning unit 152 and may share a component for printing a received file with the printing unit 151. The fax unit 153 may transmit a scanned file to a destination or receive a file from the outside.

The sensor unit 160 includes various sensors. In an embodiment, the sensor unit 160 may include a humidity sensor. The humidity sensor 161 denotes a sensor that detects humidity in various manners. For example, the humidity sensor 161 may detect humidity based on electrical resistance or electrostatic capacity, which changes when moisture penetrates porous ceramic or a polymeric film, or a resonance frequency of an oscillator which changes due to a change in weight of an absorbing substance installed in the oscillator. Also, the humidity sensor 161 may include a relative humidity sensor detecting relative humidity and an absolute humidity sensor detecting absolute humidity. In an embodiment, the humidity sensor 161 may include a psychrometer, a hair hygrometer, a lithium chloride hygrometer, an electrolytic hygrometer (a $P_2O_5$ hygrometer), a polymer hygrometer, a quartz oscillator hygrometer, an aluminum oxide hygrometer, a ceramic hygrometer, a thermistor hygrometer, a microwave hygrometer, a dew sensor, a dew point sensor, an integrated circuit (IC) hygrometer in which a hygrometer device and a signal-processing electronic circuit are integrated, or the like.

In an embodiment, the sensor unit 160 may further include a temperature sensor. The temperature sensor detects a temperature and may use a thermistor, a thermocouple, a resistance temperature detector, thermo sensitive ferrite, or the like.

Furthermore, in an embodiment, the sensor unit 160 may include a humidity/temperature sensor in which the humidity sensor and the temperature sensor are combined.

The power supply 170 may supply power to each component of the image forming apparatus 100. In an embodiment, the power supply 170 may supply power to the image forming job unit 150. In particular, the power supply 170 may supply power to the transfer unit 1515 of the printing unit 151.

Figure 3:
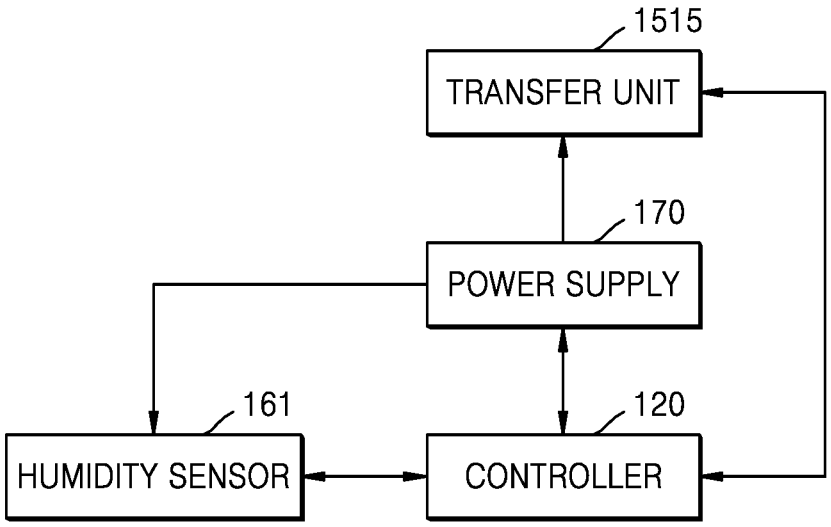
FIG. 3 is a detailed block diagram showing an internal structure of an image forming apparatus according to an embodiment.

FIG. 3 is a detailed block diagram showing an internal structure of an image forming apparatus according to an embodiment.

FIG. 3 shows in more detail some of components of the image forming apparatus 100 of FIG. 1 which are used to control transfer power. Therefore, repeated descriptions regarding the components will be provided only briefly.

The humidity sensor 161 measures humidity around the image forming apparatus 100 and transmits a humidity measurement result to the controller 120. In this case, the sensor unit 160 may further include a temperature sensor (not shown) in addition to the humidity sensor 161 to measure a temperature around the image forming apparatus 100 and may transmit a temperature measurement result as well as the humidity measurement result to the controller 120.

The transfer unit 1515 transfers an image formed on the photoreceptor 1511 to a transfer medium P, according to the control of the controller 120. In this case, the power supply 170 supplies the transfer power to the transfer unit 1515.

The power supply 170 respectively supplies power to the transfer unit 1515, the humidity sensor 161, the controller 120, and the like included in the image forming apparatus 100. In an embodiment, the power supply 170 may apply a transfer current to the transfer unit 1515 so as to supply the transfer power thereto. In an embodiment, the power supply 170 may supply the transfer power to the transfer unit 1515, by using a constant current (CC) method of transmitting a constant amount of charges necessary to transfer the image, in which a current, in particular, a constant current, is applied.

The controller 120 may control all operations of the image forming apparatus 100. In an embodiment, the controller 120 controls the transfer power supplied by the power supply 170 to the transfer unit 1515. In more detail, the controller 120 may determine a sensing feedback voltage by applying a preset sensing current to the transfer unit 1515 and measuring a first output voltage of the transfer unit 1515 in a certain time period before the image is transferred to the transfer medium P. In this case, when humidity measured by the humidity sensor 161 is higher than a preset value, the controller 120 may set a target voltage based on the determined sensing feedback voltage and may control the power supply 170 to adjust a transfer current so as to apply the target voltage to the transfer unit 1515 in a time period in which the image is transferred to the transfer medium P.

In an embodiment, the controller 120 may differently set target voltages according to types of transfer media. In more detail, according to the types of transfer media such as materials and sizes thereof, the target voltages may differ. For example, since characteristics of materials differ according to whether the transfer medium P is common paper, an over head projector (OHP) film, photo-printing paper, or coated paper, the target voltages may also differ. In addition, since an area of a portion to be charged differs according to whether the transfer medium P has a size of A4, A5, or A6, the target voltages may also differ.

In an embodiment, when the transfer current is adjusted to apply the target voltage to the transfer unit 1515 in the time period in which the image is transferred to the transfer medium P, the controller 120 may increase the transfer current applied by the power supply 170 to the transfer unit 1515 until the first output voltage reaches the target voltage. Also, when the first output voltage reaches the target voltage, the controller 120 may control the transfer power supplied by the power supply 170 to the transfer unit 1515 to maintain the target voltage. Detailed descriptions will be provided with reference to FIGS. 4 to 6.

Figure 4:
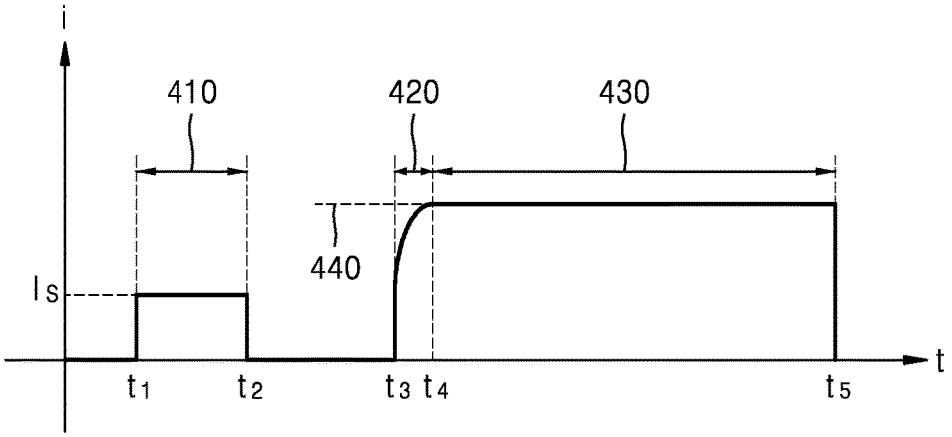
FIG. 4 is a timing diagram of a transfer performed using a pseudo constant voltage (CV) method, according to an embodiment.

FIG. 4 is a timing diagram of a transfer performed using a pseudo CV method, according to an embodiment.

Referring to FIG. 4, in an embodiment, the controller 120 applies a sensing current Is that is preset in the transfer unit 1515 during an interval t1-t2 410 that is a certain time period before the image is transferred to the transfer medium P. In an embodiment, the certain time period before the image is transferred to the transfer medium P may be a time period before the transfer medium P is inserted into the transfer unit 1515. For example, when the transfer medium P is paper, the interval t1-t2 410 may correspond to a non-paper feeding time period in which paper has not yet been inserted.

A sensing feedback voltage according to the sensing current Is may be determined by measuring an output voltage in the transfer unit 1515. Also, the controller 120 measures humidity around the image forming apparatus 100 by using the humidity sensor 161. When the humidity measured by the controller 120 is higher than a preset value, the controller 120 may set a target voltage based on the sensing feedback voltage and may control the power supply 170 to adjust the transfer current in order to apply the target voltage to the transfer unit 1515 during intervals t3-t4 and t4-t5 420 and 430 that are time periods in which the image is transferred to the transfer medium P.

In an embodiment, when the transfer current is adjusted to apply the target voltage to the transfer unit 1515 during the intervals t3-t4 and t4-t5 420 and 430 that are time periods in which the image is transferred to the transfer medium P, the controller 120 may increase the transfer current, which is applied by the power supply 170 to the transfer unit 1515, during the interval t3-t4 420 until the first output voltage reaches the target voltage. Then, when the first output voltage reaches the target voltage, the controller 120 may maintain a transfer current 440 applied by the power supply 170 to the transfer unit 1515 in order to maintain the target voltage for the interval t4-t5 430. That is, according to an embodiment, the controller 120 may control the power supply 170 that supplies a current to the transfer unit 1515 and may transfer the image by using the pseudo CV method that is similar to a CV method. Thus, manufacturing costs of an image forming apparatus may be reduced because the CV method may be implemented without a separate power supply that supplies a voltage.

In an embodiment, the interval t3-t4 420, which is the time period during which the first output voltage increases until it reaches the target voltage, may be a non-image time period in which the image has not been transferred to the transfer medium P. Since the image has not been transferred to the transfer medium P in the non-image time period, the transfer process is not affected even though the first output voltage has not reached the target voltage. The interval t4-t5 430, which is the time period after the first output voltage reaches the target voltage, may be an image time period in which the image is being transferred to the transfer medium P. Furthermore, the interval t3-t4 420, which is the time period in which the first output voltage increases until it reaches the target voltage, may include a small portion of the image time period, in addition to the non-image time period in which the image has not been transferred to the transfer medium P. Although the interval t3-t4 420 includes the small portion of the image area, the small portion is still part of the entire image area, and thus the first output voltage is likely to exceed an effective transfer voltage such that transfer quality is not greatly affected.

In an embodiment, when the humidity measured by the humidity sensor 161 is lower than a preset value or when the sensing feedback voltage is equal to or higher than a preset voltage, a target current may be set based on the sensing feedback voltage. In this case, the controller 120 may control the power supply 170 to apply a transfer current corresponding to the target current in the intervals t3-t4 and t4-t5 420 and 430 in which the image is transferred to the transfer medium P.

According to an embodiment, when the humidity is measured by the humidity sensor 161 and is equal to or higher than the preset value, the controller 120 may supply the transfer power to the transfer unit 1515 by using the pseudo CV method. When the measured humidity is lower than the preset value or when the sensing feedback voltage is equal to or higher than the preset voltage, the controller 120 may supply the transfer power to the transfer unit 1515 by using the CC method. Accordingly, the transfer power may be supplied by one power supply by using two methods, depending on environmental conditions.

FIG. 5 is tables of examples of transfer power application methods according to environmental conditions.

Referring to FIG. 5, a standard level of humidity for classifying a high-humidity environment and a low-humidity environment is 60%. When the humidity is equal to or higher than 60%, the transfer power is applied by using the pseudo CV method, and when the humidity is lower than 60%, the transfer power is applied by using the CC method.

First of all, referring to table 510, when the humidity measured by the humidity sensor 161 is equal to or higher than 60%, the transfer power application method is the pseudo CV method, and a target voltage may differ depending on the sensing feedback voltage and a paper type. For example, when the humidity is 80%, the sensing feedback voltage is 200 V, and paper C is used, the target voltage may be 1120 V.

Referring to table 520, when the humidity measured by the humidity sensor 161 is lower than 60%, the transfer power is applied by using the CC method, and like above, a target current may differ according to the sensing feedback voltage and the paper type. For example, when the humidity is 40%, the sensing feedback voltage is 3000 V, and paper A is used, the target current may be 9.2 μA.

FIG. 6 is a table of an example of a transfer power application method according to an environmental condition and a sensing feedback voltage.

Referring to FIG. 6, although the humidity measured by the humidity sensor 161 is equal to or higher than 60%, the transfer power may be applied by using either the pseudo CV method or the CC method, according to the sensing feedback voltage.

Even in a high-humidity environment, for example, an environment in which the humidity is 60% as shown in FIG. 6, if a transfer member is highly resistive, for example, if the sensing feedback voltage exceeds 100 V, a sufficient amount of resistance may be secured by using the CC method, and thus an effective transfer voltage may be secured. Therefore, when the sensing feedback voltage is equal to or higher than the preset voltage, the transfer quality may be secured by using the CC method regardless of the humidity measured by the humidity sensor 161.

For example, when the humidity measured by the humidity sensor 161 is 80% and the sensing feedback voltage is 500 V, an effective transfer voltage may be secured, and thus the transfer power may be supplied by using the CC method. In this case, when paper B is used, the target current may be 14.8 μA.

Referring back to FIG. 3, the controller 120 may set the effective transfer voltage based on the humidity measured by the humidity sensor 161. In the time period in which the image is transferred to the transfer medium P, when a second output voltage of the transfer unit 1515, which is measured by applying the transfer current to a terminal of the transfer medium P, is lower than or equal to the effective transfer voltage after the transfer medium P is inserted into the transfer unit 1515, the controller 120 may increase the transfer current applied by the power supply 170 to the transfer unit 1515 until the second output voltage reaches the effective transfer voltage. Then, when the second output voltage reaches the effective transfer voltage, the controller 120 may control the transfer current applied by the power supply 170 to the transfer unit 1515 in order to maintain the effective transfer voltage.

Also, the controller 120 may set the effective transfer voltage based on the humidity measured by the humidity sensor 161. In the time period in which the image is transferred to the transfer medium P, when a second output voltage of the transfer unit 1515, which is measured by applying the transfer current to a terminal of the transfer medium P, is lower than or equal to the effective transfer voltage after the transfer medium P is inserted into the transfer unit 1515, the controller 120 may set the target voltage based on the second output voltage. Then, in the time period in which the image is transferred to the transfer medium P, the controller 120 may control the power supply 170 to adjust the transfer current in order to apply the target voltage to the transfer unit 1515. This will be described in detail below with reference to FIGS. 7 to 9.

Figure 7:
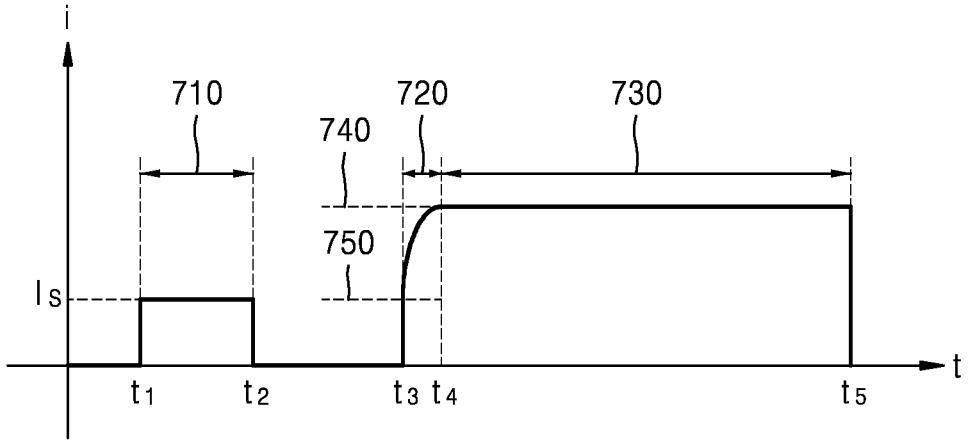
FIG. 7 is a timing diagram of a transfer performed using a pseudo constant voltage method, according to an embodiment.

FIG. 7 is a timing diagram of a transfer performed using a pseudo CV method, according to an embodiment.

Referring to FIG. 7, the controller 120 applies a preset sensing current Is to the transfer unit 1515 in an interval t1-t2 710 that is a certain time period before the image is transferred to the transfer medium P. In an embodiment, the time period before the image is transferred to the transfer medium P may be a certain time period before the transfer medium P is inserted into the transfer unit 1515. For example, when the transfer medium P is paper, the interval t1-t2 710 may be a non-paper feeding time period in which paper has not yet been inserted.

Then, a sensing feedback voltage according to the sensing current Is may be determined by measuring an output voltage in the transfer unit 1515. Also, the controller 120 measures humidity around the image forming apparatus 100 by using the humidity sensor 161. When the measured humidity is lower than a preset value, the controller 120 may set a target current based on the sensing feedback voltage and may control the power supply 170 to apply, to the transfer unit 1515, the transfer current corresponding to the target current in intervals t3-t4 and t4-t5 720 and 730 that are time periods in which the image is transferred to the transfer medium P.

In an embodiment, the controller 120 may change the transfer power application method to the pseudo CV method when the second output voltage of the transfer unit 1515, which is measured by applying the transfer current to the terminal of the transfer medium P, is lower than the effective transfer voltage in the intervals t3-t4 and t4-t5 720 and 730 in which the image is transferred to the transfer medium P. In more detail, the controller 120 may increase the transfer current applied by the power supply 170 to the transfer unit 1515 until the second output voltage of the transfer unit 1515, which is measured by applying the transfer current to the terminal of the transfer medium P, reaches the effective transfer voltage. Also, the controller 120 may control the transfer current, which is applied by the power supply 170 to the transfer unit 1515, to maintain the effective transfer voltage in the interval t4-t5 730 that is the time period after the second output voltage reaches the effective transfer voltage.

Furthermore, in an embodiment, the controller 120 may directly set the target voltage based on the second output voltage when the second output voltage of the transfer unit 1515, which is measured by applying the transfer current to the terminal of the transfer medium P, is lower than the effective transfer voltage. Then, the controller 120 may control the power supply 170 to adjust the transfer current in order to apply the target voltage to the transfer unit 1515 in the time period in which the image is transferred to the transfer medium P.

In a boundary area between the CC method and the pseudo CV method, for example, when the CC method or the pseudo CV method is selected based on humidity of 60%, if the measured humidity is about 60%, poor transfer may occur even though the transfer power is applied by using the selected method. In an embodiment, the image forming apparatus 100 may smoothly change the transfer power application method according to a current state so as to secure the transfer quality.

FIG. 8 is a table of an example of a transfer power application method in a boundary between a CC method and a pseudo CV method.

FIG. 8 shows an example of applying transfer power by using the CC method by targeting the effective transfer voltage that is set based on the humidity when the second output voltage of the transfer unit 1515, which is measured by applying the transfer current to the terminal of the transfer medium P, is lower than the effective transfer voltage.

For example, when the humidity is 58% and paper A is used, the effective transfer voltage is 490 V. Referring to FIG. 8, since the humidity is lower than or equal to 60%, the transfer power may be applied by using the CC method. In this case, when the second output voltage of the transfer unit 1515, which is measured by applying the transfer current to the terminal of the transfer medium P, is lower than or equal to 490 V of the effective transfer voltage, the transfer power application method is changed to the pseudo CV method. In this case, when the transfer current is controlled to make the second output voltage reach 490 V that is the effective transfer voltage according to the humidity, and when the second output voltage reaches 490 V that is the effective transfer voltage, the transfer current may be controlled to maintain the effective transfer voltage.

FIG. 9 is a table of an example of a transfer power application method used according to the sensing feedback voltage, in the boundary area between the CC method and the pseudo CV method.

FIG. 9 shows an example of applying the transfer power by using the CC method by targeting the effective transfer voltage that is set based on the second output voltage, when the second output voltage of the transfer unit 1515, which is measured by applying the transfer current to the terminal of the transfer medium P, is lower than or equal to the effective transfer voltage.

For example, by taking the measured humidity into account, when paper B is used, the effective transfer voltage may be set to be 500 V. When an initial transfer power application method is the CC method, if the second output voltage of the transfer unit 1515, which is measured by applying the transfer current to the terminal of the transfer medium P, is 300 V that is lower than 500 V of the effective transfer voltage, the transfer power application method may be changed to the pseudo CV method. In this case, when the transfer current is controlled to make the second output voltage of 300 V reach a preset target voltage of 410 V, and when the second output voltage reaches the effective transfer voltage of 410 V, the transfer current may be controlled to maintain the effective transfer voltage.

Referring back to FIG. 3, in an embodiment, a third output voltage of the transfer unit 1515, which is measured by applying the transfer current to the terminal of the transfer medium P, is higher than a preset threshold value, after the transfer medium P is inserted into the transfer unit 1515 in the time period in which the image is transferred to the transfer medium P, the controller 120 may determine that the transfer member has reached its lifetime limit. For example, when the third output voltage reaches about 90% of an over voltage protection (OVP) voltage of a high voltage power source (HVPS), the controller 120 may determine that the transfer member has reached its lifetime limit.

In an embodiment, voltage sensing is performed based on a current state of the transfer member, that is, resistance of the transfer member, and thus the lifetime of the transfer member may be accurately determined. The image forming apparatus 100 may measure the lifetime of the transfer member through voltage sensing in a certain cycle or during the occurrence of events and may display a replacement notification to the user through the I/O 110 when the lifetime of the transfer member reaches the lifetime limit. In an embodiment, since the user may replace the transfer member with a new transfer member at an appropriate time, a transfer failure may be prevented, and breakdown of the HVPS due to excessive transfer power use may be prevented.

Each component of the image forming apparatus 100 has been described. Hereinafter, a method of controlling the transfer power by using the components of the image forming apparatus 100 will be described.

Figure 10:
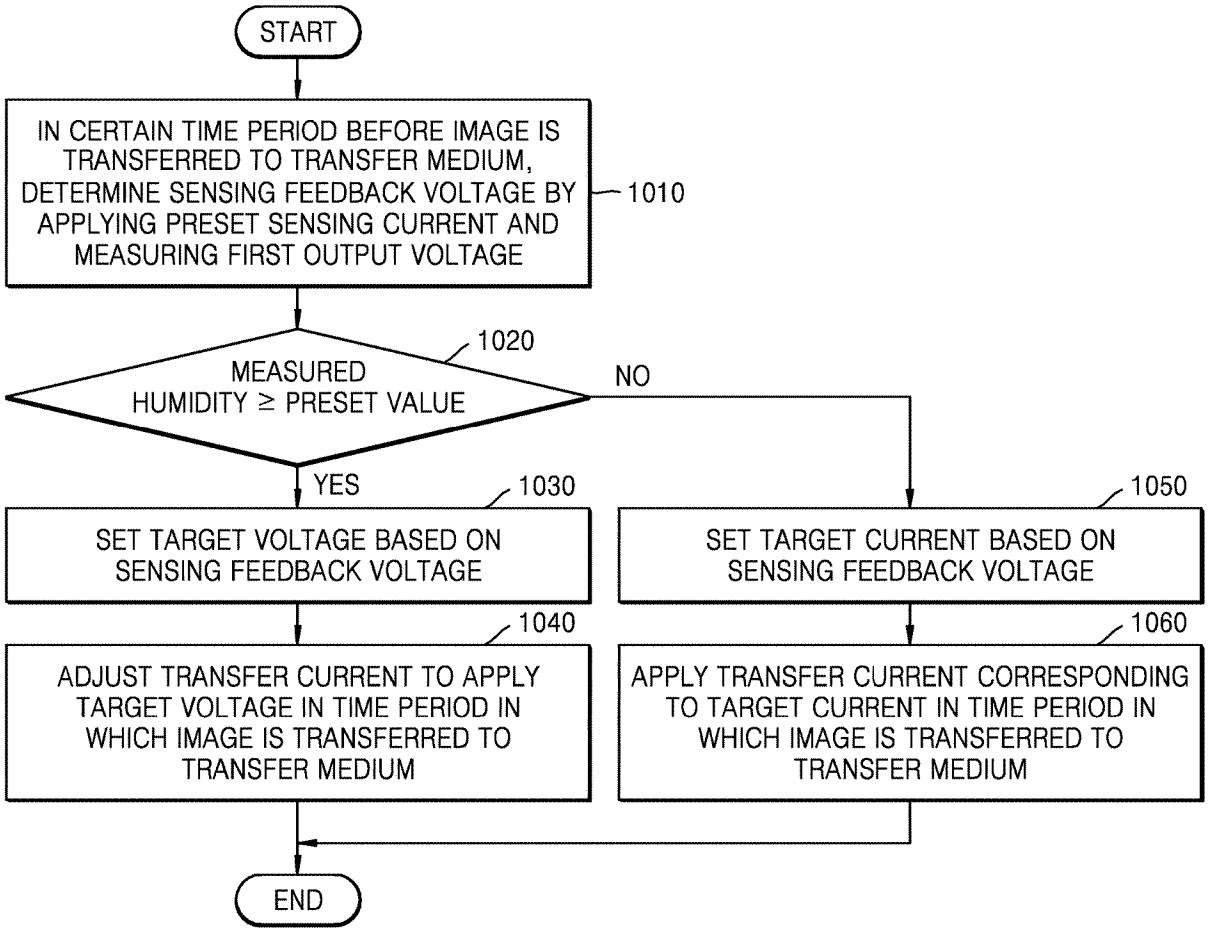
FIG. 10 is a flowchart of a method of controlling transfer power of an image forming apparatus, according to an embodiment.

FIG. 10 is a flowchart of a method of controlling transfer power of the image forming apparatus 100, according to an embodiment.

In operation 1010, the image forming apparatus 100 may determine the sensing feedback voltage by applying the preset sensing current and measuring the first output voltage in the time period in which the image is transferred to the transfer medium P. In an embodiment, the time period in which the image is transferred to the transfer medium P may be the time period in which the image has not yet been inserted into the transfer medium P. For example, when the transfer medium P is paper, the time period before the image is transferred to the transfer medium P may be the non-paper feeding time period in which paper has not yet been inserted.

Then, in operation 1020, the image forming apparatus 100 may measure humidity and may compare the measured humidity with a preset value.

In operation 1020, when the measured humidity is lower than the preset value, the image forming apparatus 100 may proceed with operation 1030 and may set the target voltage based on the sensing feedback voltage. In an embodiment, the image forming apparatus 100 may differently set target voltages according to types of transfer media. In more detail, the target voltages may differ according to characteristics of the transfer medium P such as materials and sizes thereof. For example, since characteristics of materials differ according to whether the transfer medium P is normal paper, an OHP film, photo-printing paper, coated paper, etc., the target voltages may differ. Also, since an area of a portion to be charged differs according to whether a paper size is A4, A5, or A6, the target voltages may also differ.

Then, in operation 1040, the image forming apparatus 100 may adjust the transfer current to apply the target voltage in the time period in which the image is transferred to the transfer medium P.

According to an embodiment, the image forming apparatus 100 may perform the transfer process by using the pseudo CV method that is similar to the CV method of transferring an image by controlling the power supply 170 that applies a current to the transfer unit 1515. Therefore, since the constant voltage method may be implemented without a power supply of applying a voltage, manufacturing costs of an image forming apparatus may be reduced.

In operation 1020, when the measured humidity is lower than the preset value, the image forming apparatus 100 may proceed with operation 1050 and may set the target current based on the sensing feedback voltage. Also, although not shown in FIG. 10, the image forming apparatus 100 may set the target current based on the sensing feedback voltage when the sensing feedback voltage is higher than the preset voltage.

Then, in operation 1060, the image forming apparatus 100 may apply a transfer current corresponding to the target current in the section in which the image is transferred to the transfer medium P.

In an embodiment, the transfer power of the image forming apparatus 100 may be provided by one power supply by using two methods, depending on environmental conditions.

Figure 11:
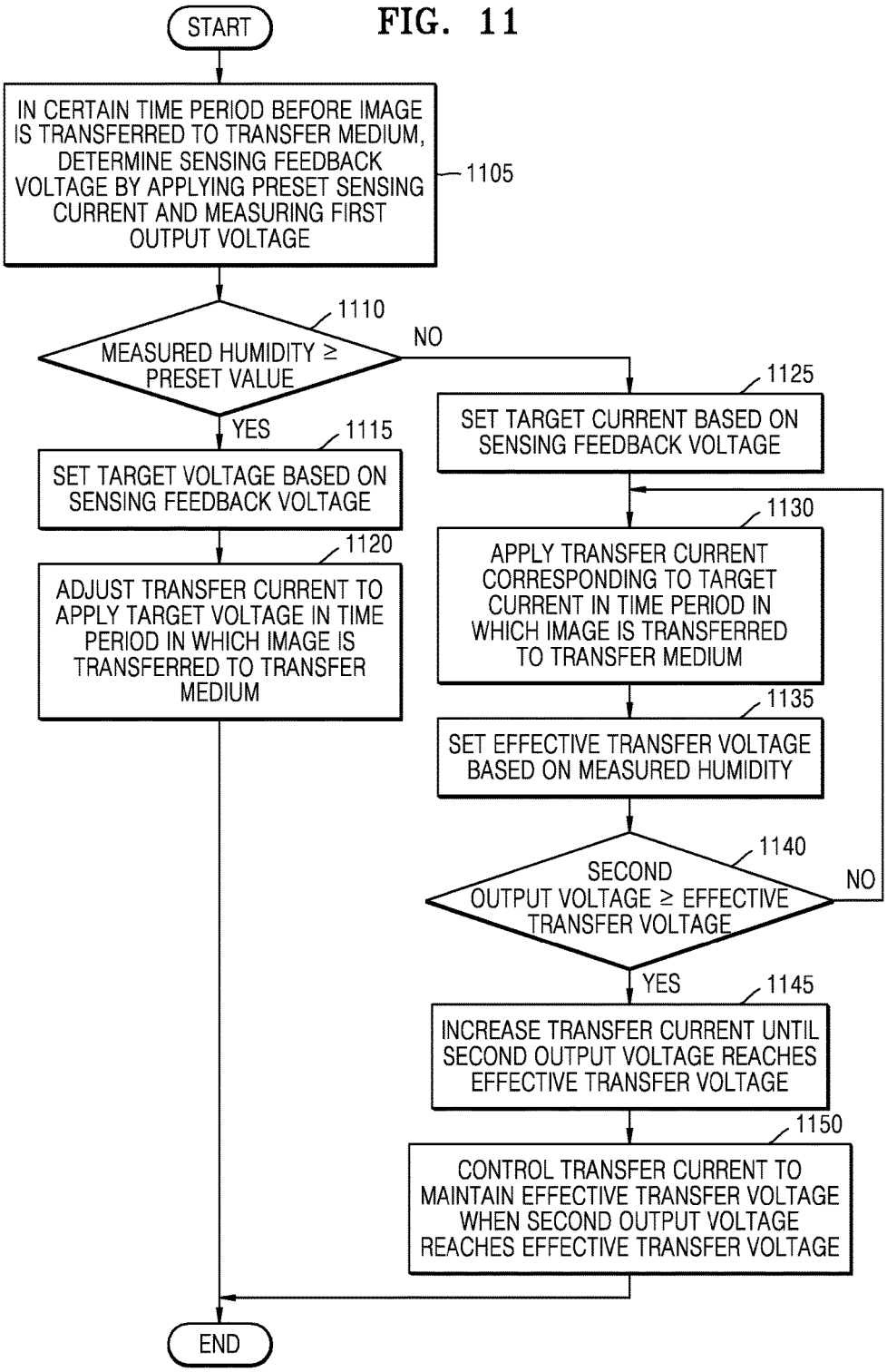
FIG. 11 is a flowchart of a method of controlling transfer power of an image forming apparatus, according to another embodiment.

FIG. 11 is a flowchart of a method of controlling transfer power of the image forming apparatus 100, according to another embodiment.

Operations 1105, 1110, 1115, and 1120 of FIG. 11 are the same as operations 1010, 1020, 1030, and 1040 of FIG. 10, and operations 1125 and 1130 of FIG. 11 are the same as operations 1050 and 1060 of FIG. 10. Therefore, repeated descriptions thereof will be only briefly provided.

In operation 1105, the image forming apparatus 100 may determine the sensing feedback voltage by applying the preset sensing current and measuring the first output voltage in the certain time period before the image is transferred to the transfer medium P.

Then, in operation 1110, the image forming apparatus 100 may measure humidity and may compare the measured humidity with the preset value.

In operation 1110, when the measured humidity is lower than the preset value, the image forming apparatus 100 may proceed with operation 1115 and may set the target voltage based on the sensing feedback voltage. Then, in operation 1120, the image forming apparatus 100 may adjust the transfer current to apply the target voltage in the time period in which the image is transferred to the transfer medium P.

In operation 1110, when the measured humidity is higher than the preset value, the image forming apparatus 100 may proceed with operation 1125 and may set the target voltage based on the sensing feedback voltage. Then, in operation 1130, the image forming apparatus 100 may adjust the transfer current to apply the target voltage in the time period in which the image is transferred to the transfer medium P.

In operation 1135, the image forming apparatus 100 may set the effective transfer voltage based on the measured humidity. Then, in operation 1140, the image forming apparatus 100 compares the effective transfer voltage with the second output voltage measured by applying the transfer current to the terminal of the transfer medium P.

In operation 1140, when the second output voltage exceeds the effective transfer voltage, the image forming apparatus 100 proceeds with operation 1130 again and adjusts the transfer current to apply the target voltage in the time period in which the image is transferred to the transfer medium P. That is, the image forming apparatus 100 maintains a current transfer current.

In operation 1140, when the second output voltage is lower than or equal to the effective transfer voltage, the image forming apparatus 100 proceeds with operation 1145 and increases the transfer current until the second output voltage reaches the effective transfer voltage. Then, in operation 1150, the image forming apparatus 100 controls the transfer current to maintain the effective transfer voltage when the second output voltage reaches the effective transfer voltage.

Also, although not shown in FIG. 11, when the output voltage is lower than the effective transfer voltage, the image forming apparatus 100 may set the target voltage based on the second output voltage and may adjust the transfer current to apply the target voltage in the time period in which the image is transferred to the transfer medium P.

In an embodiment, the image forming apparatus 100 may smoothly change the transfer power application method according to a current state so as to ensure transfer quality.

Figure 12:
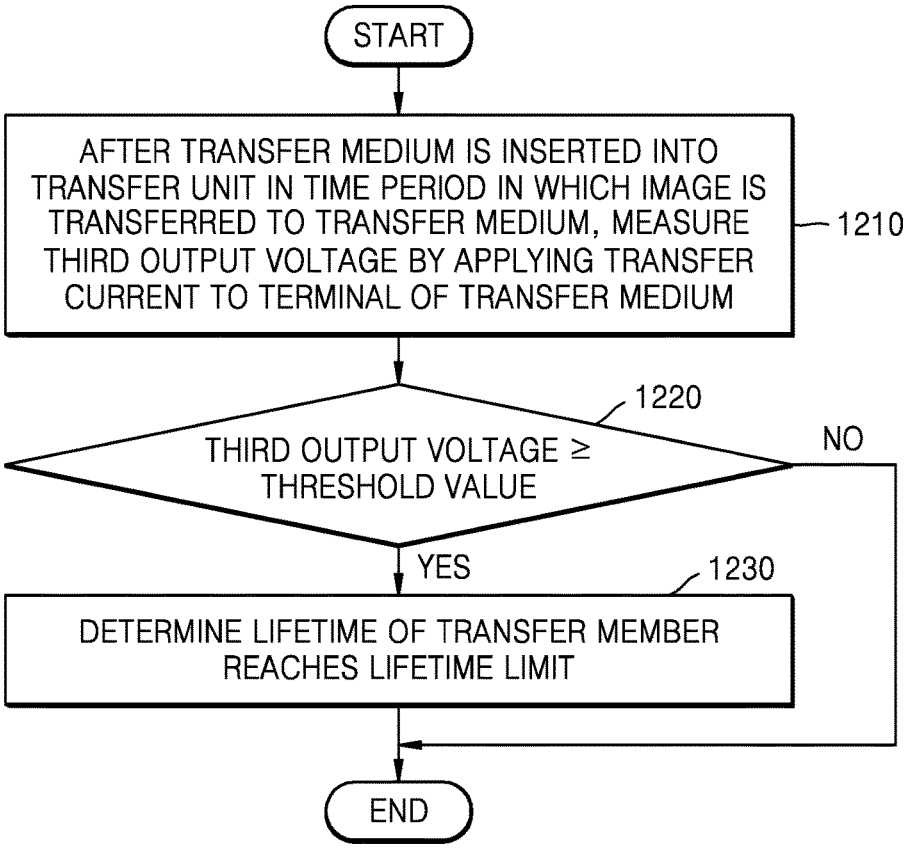
FIG. 12 is a flowchart of a method of determining a lifetime limit of a transfer member, according to an embodiment.

FIG. 12 is a flowchart of a method of determining a lifetime limit of a transfer member, according to an embodiment.

In operation 1210, the image forming apparatus 100 may measure the output voltage by applying the transfer current to the terminal of the transfer medium P after the transfer medium P is inserted into the transfer unit in the time period in which the image is transferred to the transfer medium P.

Then, in operation 1220, the image forming apparatus 100 determines whether the third output voltage is lower than or equal to the threshold value, and when the third output voltage is equal to or higher than the threshold value, the image forming apparatus 100 proceeds with operation 1230 and determines that the transfer member has reached its lifetime limit. For example, when the third output voltage reaches about 90% of the OVP voltage of the HVPS, the image forming apparatus 100 may determine that the transfer member has reached its lifetime limit.

In operation 1220, when the third output voltage is lower than the threshold value, the transfer process is terminated.

According to an embodiment, the voltage sensing is performed based on the current state of the transfer member, that is, the resistance of the transfer member, and thus the lifetime of the transfer member may be accurately determined.

The embodiments may be embodied as a non-transitory computer-readable recording medium in which data and an instruction executable by a computer are stored. At least one of the instruction and the data may be stored as a program code and, when executed by a processor, may perform a certain operation by generating a certain program module.

Examples of the non-transitory computer-readable recording medium include magnetic storage media (e.g., hard disks, etc.), optical recording media (e.g., CD-ROMs, or DVDs), etc. and may also include a memory included in a server which may is accessible through a network. For example, the non-transitory computer-readable recording medium may be at least one of the memory 140 of the image forming apparatus 100 and a memory of the I/O 110 or may be a memory included in an external device connected to the image forming apparatus 100 via a network.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. An image forming apparatus comprising:

a humidity sensor to measure humidity;

a transfer unit to perform an operation to transfer an image on a photoreceptor to a transfer medium;

a power supply to supply transfer power to the transfer unit to output a transfer voltage, by applying a transfer current to the transfer unit; and a controller to control the transfer power supplied by the power supply to the transfer unit, wherein, when the transfer unit is to perform the operation to transfer the image, the controller, applies, during a time period before the transfer unit transfers the image on the photoreceptor, a set sensing current to the transfer unit, and measures a first output voltage of the transfer unit in response to the applied set transfer current to determine a sensing feedback voltage, determines whether to set a target voltage of the transfer voltage or to set a target current of the transfer current, based on comparing the determined sensing feedback voltage with a set voltage value, and comparing the humidity measured by the humidity sensor with a set humidity value, sets the target voltage based on the determined sensing feedback voltage, when the humidity measured by the humidity sensor is equal to or higher than the set humidity value and the sensing feedback voltage is lower than the set voltage value, and controls, during a time period in which the transfer medium is inserted into the transfer unit, the power supply to adjust the transfer current to control the transfer voltage to reach the set target voltage.

2. The image forming apparatus of claim 1, wherein, when the controller controls the power supply to adjust the transfer current to apply the target voltage to the transfer unit during the time period in which the transfer medium is inserted into transfer unit to transfer the image, the controller controls the power supply to increase the transfer current, which is applied to the transfer unit, until the target voltage, from the first output voltage, reaches the target voltage and controls the power supply to apply the transfer current to the transfer unit, to maintain the target voltage when the transfer voltage reaches the target voltage.

3. The image forming apparatus of claim 1, wherein, when the humidity measured by the humidity sensor is lower than the set value, or when the sensing feedback voltage is equal to or higher than the set voltage value, the controller sets the target current based on the sensing feedback voltage, and controls the power supply to apply the transfer current corresponding to the target current to the transfer unit during the time period in which the transfer medium is inserted into the transfer unit.

4. The image forming apparatus of claim 3, wherein, when the controller controls the power supply to apply the transfer current corresponding to the target current to the transfer unit, the controller:

sets an effective transfer voltage based on the humidity measured by the humidity sensor;

when a second output voltage of the transfer unit, which is measured by applying the transfer current to a terminal of the transfer medium, is lower than or equal to the effective transfer voltage during the time period in which the transfer medium is inserted into the transfer unit, controls the power supply to increase the transfer current, which is applied to the transfer unit, until the second output voltage reaches the effective transfer voltage; and controls the power supply to apply the transfer current to the transfer unit, to maintain the effective transfer voltage when the second output voltage reaches the effective transfer voltage.

5. The image forming apparatus of claim 3, wherein, when the controller controls the power supply to apply the transfer current corresponding to the target current to the transfer unit, the controller:

sets an effective transfer voltage based on the humidity measured by the humidity sensor;

when a second output voltage of the transfer unit, which is measured by applying the transfer current to a terminal of the transfer medium, is lower than or equal to the effective transfer voltage during the time period in which the transfer medium is inserted into the transfer unit, sets the target voltage based on the second output voltage; and controls the power supply to adjust the transfer current in order to apply the target voltage to the transfer unit during the time period in which the image is transferred to the transfer medium.

6. The image forming apparatus of claim 1, wherein, when the controller determines to set the target voltage, the controller sets a level of the target voltage corresponding to the transfer medium, among different levels of the target voltage corresponding to transfer medium types.

7. The image forming apparatus of claim 1, wherein the time period before the image is transferred to the transfer medium is a time period before the transfer medium is inserted into the transfer unit.

8. The image forming apparatus of claim 1, wherein the transfer unit includes a transfer member, and the controller determines that a lifetime of the transfer member reaches a lifetime limit when a third output voltage of the transfer unit, which is measured by applying the transfer current to a terminal of the transfer medium, is equal to or higher than a set threshold value during the time period the transfer medium is inserted into the transfer unit.

9. A method of controlling transfer power of an image forming apparatus including a transfer unit to perform an operation to transfer an image on a photoreceptor to a transfer medium, the method comprising:

measuring, by a humidify sensor, a humidity; and by a controller, when the transfer unit is to perform the operation to transfer the image with a transfer current and a transfer voltage:

applying, during a time period before the transfer unit is to transfer the image on the photoreceptor, a set sensing current to the transfer unit, and measuring a first output voltage of the transfer unit in response to the applied set transfer current to determine a sensing feedback voltage;

determining whether to set a target voltage of the transfer voltage, or to set a target current of the transfer current, based on comparing the determined sensing feedback voltage with a set voltage value, and comparing the measured humidity with a set humidity value;

setting the target voltage based on the determined sensing feedback voltage when the measured humidity is equal to or higher than the set value and the sensing feedback voltage is lower than the set voltage value; and adjusting, during a time period in which the transfer medium is inserted into the transfer unit, the transfer current applied to the transfer unit, to control the transfer voltage to reach the target voltage.

10. The method of claim 9, wherein the adjusting the transfer current to control the transfer voltage to reach the target voltage comprises:

increasing the transfer current until the target voltage, from the first output voltage, reaches the target voltage; and controlling the transfer current to maintain the target voltage when the transfer voltage reaches the target voltage.

11. The method of claim 9, further comprising:

setting the target current based on the sensing feedback voltage, in response to the determining to set the target voltage when the measured humidity is lower than the set value, or when the determined sensing feedback voltage is equal to or higher than a set voltage; and applying the transfer current corresponding to the target current during the time period in which the transfer medium is inserted into the transfer unit.

12. The method of claim 11, further comprising:

in response to the applying the transfer current corresponding to the target current, setting an effective transfer voltage based on the measured humidity;

when a second output voltage, which is measured by applying the transfer current to a terminal of the transfer medium, is lower than or equal to the effective transfer voltage during the time period in which the transfer medium is inserted into the transfer unit, increasing the transfer current until the second output voltage reaches the effective transfer voltage; and controlling the transfer current to maintain the effective transfer voltage when the second output voltage reaches the effective transfer voltage.

13. The method of claim 11, further comprising:

in response to the applying the transfer current corresponding to the target current, setting an effective transfer voltage based on the measured humidity;

when a second output voltage, which is measured by applying the transfer current to a terminal of the transfer medium, is lower than or equal to the effective transfer voltage during the time period in which the transfer medium is inserted into the transfer unit, setting a target voltage based on the second output voltage; and adjusting the transfer current to apply the target voltage during the time period in which the image is transferred to the transfer medium.

14. The method of claim 9, wherein the setting the target voltage based on the determined sensing feedback voltage when the measured humidity is equal to or higher than the set value includes setting a level of the target voltage corresponding to the transfer medium, among different levels of the target voltage corresponding to transfer medium types.

15. The method of claim 9, wherein the time period before the image is transferred to the transfer medium is a time period before the transfer medium is inserted into the transfer unit.

16. The method of claim 9, further comprising:

determining that a lifetime of a transfer member included in the transfer unit reaches a lifetime limit when a third output voltage, which is measured by applying the transfer current to a terminal of the transfer medium, is equal to or higher than a set threshold value during the time period the transfer medium is inserted into the transfer unit.

17. A non-transitory computer-readable recording medium having embodied thereon a computer program which, when executed by a computer, performs the method of claim 9.

* * * * *